US005447451A

United States Patent [19]

Bishop

[11] Patent Number: 5,447,451

[45] Date of Patent: Sep. 5, 1995

[54] CONNECTOR TERMINALS

[75] Inventor: Julian J. Bishop, Belmont, Mass.

[73] Assignee: Ark-Les Corporation, Watertown, Mass.

[21] Appl. No.: 227,124

[22] Filed: Apr. 13, 1994

[51] Int. Cl.[6] ..... H01R 4/24
[52] U.S. Cl. ..... 439/422; 439/877
[58] Field of Search ..... 439/422, 877, 885

[56] References Cited

U.S. PATENT DOCUMENTS

| | | | |
|---|---|---|---|
| 3,097,906 | 7/1963 | Shannon | 439/855 |
| 3,997,223 | 12/1976 | Evans | 439/422 |
| 4,248,493 | 2/1981 | Kuo | 439/422 X |
| 4,834,673 | 5/1989 | Beinhaur et al. | 439/422 |

*Primary Examiner*—Eugene F. Desmond

[57] ABSTRACT

The invention features a strip of terminals formed from a single piece of sheet stock. The terminals have a clamp portion connected through a spring section to a base so that the clamp portion is positioned above the base is pressed down and locked against the base to engage a tab of flexible sheet with a conductive surface.

24 Claims, 2 Drawing Sheets

CONNECTOR TERMINALS

BRIEF SUMMARY OF THE INVENTION

This invention relates to electrical connector terminals and strips thereof, particularly for connecting a wire conductor to a conductor in a flexible film.

The invention features a strip of terminals formed from a single piece of sheet stock. The terminals have a clamp portion connected through a spring section to a base so that the clamp portion is positioned above the base and is pressed down and locked against the base to engage a tab of flexible sheet with a conductive surface.

Other features will be seen from the following description.

DETAILED DESCRIPTION

The invention may be understood from the following description referring to the Figures.

Figure 1:
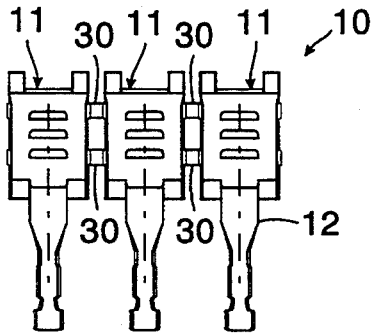
FIG. 1 shows a portion of a strip of terminals according to the invention.
Figure 2:
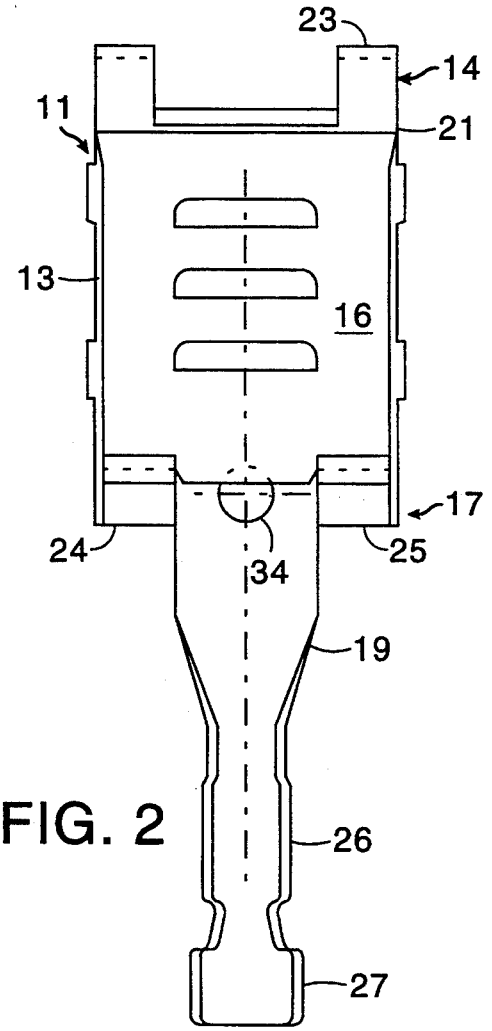
FIG. 2 show in greater detail a terminal of the strip of FIG. 1.

Referring to FIG. 1, strip 10 of terminals 11 are formed from a single sheet 12 of sheet stock. The material of the sheet stock may advantageously be made of half hard brass (CA26000, tensile 57-67 KSI) 0.020 inches thick. Terminals 11 lie side by side along strip 10 connected by bridges 30. Referring to FIG. 2, terminal 11 includes base 13 with a generally rectangular boundary, spring section 14 extending from a first portion 15 of the boundary of base 13, clamp portion 16 extending from spring section 14 in a direction away from base 13, lock section 17 extending from second portion 18 of the boundary of base 13 opposite to boundary portion 15, and wire connection neck 19 extending from boundary 18 of base 13.

Figure 3:
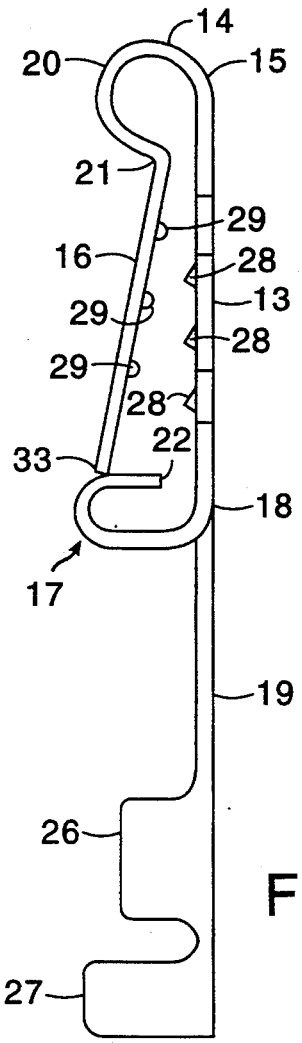
FIG. 3 shows a side view of the terminal of FIG. 2.

Referring to FIG. 3, spring section 14 is formed into a roll 20 curing up and back through an angle over 180 deg. and there is a backward bend 21 of about 90 deg. in base 13 near spring section 14 so that so that clamp portion 16 is positioned above and at an angle to base 13 with the angle opening away from spring section 14. Spring section 14 may advantageously include an aperture 23 to adjust its spring constant and admit a tab.

Lock section 17 is rolled up and back over base 13 sot hat its tip 22 provides a catch for clamp portion 16. Lock section 17 may advantageously be divided into portions 24 and 25 with wire connection neck 19 lying between the portions.

Wire connection neck 19 includes structure 26 for clamping a wire and structure 27 for clamping an insulating cover of a wire.

Base 13 includes a sharp protuberances 28 extending toward clamp portion 16, and clamp portion 16 includes rounded protuberances 29 extending toward base 13. Protuberances 28 and 29 are positioned so that when the terminal is clamped on a tab, protuberances 28 are staggered with respect to protuberances 29 rather than directly opposing one another. Depending on the structure of the tab, protuberances 28, 29 may advantageously be sharp or round in any combination.

Figure 4:
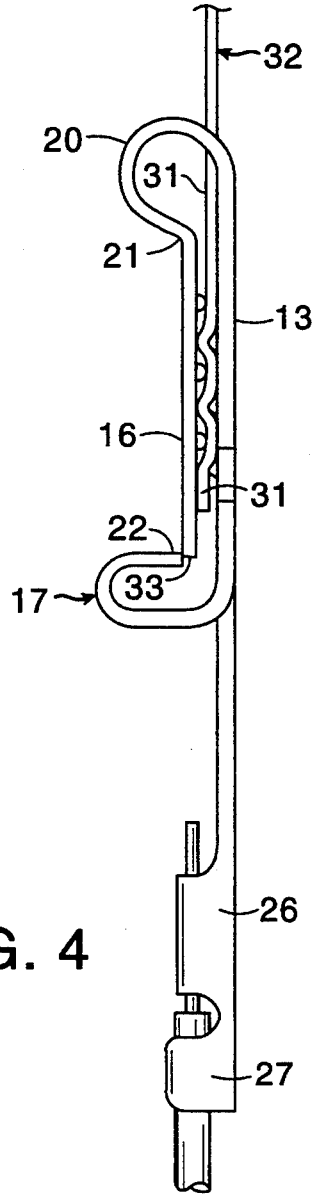
FIG. 4 shows the terminal of FIGS. 2 and 3 connecting an electrically conductive wire to tab of flexible sheet with a conductive surface.

In operation, strip 10 is processed through an assembly machine which detaches a terminal from the strip and clamps it onto the end of a wire, which may be part of a wiring harness. Then in a subsequent assembly operation the terminal is connected to a tab extending from a flexible sheet with conductive material on one surface such as are affixed to windows or mirrors to provide surface heating elements. The connection to the tab is made as shown particularly in FIG. 4 by inserting tab 31 extending from flexible sheet 32 through aperture 23 to a position between base 13 and clamp portion 16. Clamp portion 16 is then pressed down towards base 13 until its end 33 snaps under tip 22 of lock section 17. Because of the shape of the spring portion 14 and the bend 21, the clamp portion engages the tab with a rolling motion which does not scrape the tab surface, which in many cases is delicate. When the clamp portion is closed and locked under lock section 17, the staggered protuberances 28 and 29 force the tab into a serpentine shape as shown particularly in FIG. 4. This holds the tab securely in the terminal. The sharp protuberances 28 dig into the flexible sheet to hold it securely while the rounded protuberances contact the conductive surface without damaging it.

The tab may be disengaged from the terminal by inserting a tool in hole 34 and levering clamp portion 16 toward spring portion 14 to pry the end of clamp portion 16 out from under tip 22.

Figure 5:
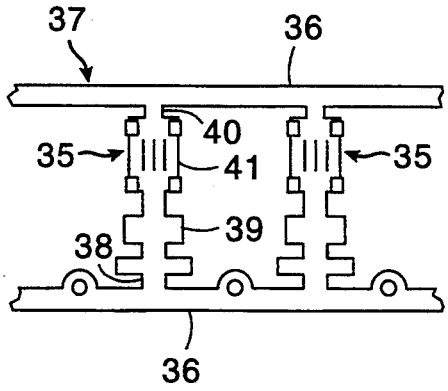
FIG. 5 shows the blank for an alternative design of a strip of terminals according to the invention.

It will be understood that alternative layouts may be used to practice the invention. In particular the wire connection neck may attach to a boundary of the base that is adjacent to the spring portion. Strip 37 with terminals so designed is shown in FIG. 5. Terminals 35 are connected to runners 36 running lengthwise of strip 37 through bridge 38 extending from the wire connection neck 39 and by bridge 40 extending from base 41.

I claim:

1. A strip of terminals formed from a single piece of sheet stock, each of said terminals being effective for electrically connecting an electrically conductive wire to a tab of a flexible sheet at least one surface of which is electrically conductive, each of said terminals having a base with a generally rectangular boundary, a spring section extending from a first portion of said base boundary, a clamp portion extending from said spring section in a direction away from said first portion of said base boundary, a lock section extending from a second portion of said base boundary opposite from said first portion of said base boundary, a wire connection neck extending from one portion of said base boundary, said spring section being bent to position said clamp portion above said base, said lock section being rolled up and back over said base so that a tip thereof provides a catch for said clamp portion.

2. A strip as claimed in claim 1, wherein said spring section is divided into two portions with an aperture therebetween for admission of said tab.

3. A strip as claimed in claim 1, wherein said clamp portion has protuberances extending toward said base for pressing against said flexible sheet.

4. A strip as claimed in claim 1, wherein said base has protuberances extending toward said clamp portion for pressing against said flexible sheet.

5. A strip as claimed in claim 1, wherein said clamp portion has protuberances extending toward said base for pressing against said flexible sheet and wherein said base has protuberances extending toward said clamp portion for pressing against said flexible sheet, said clamp protuberances and said base protuberances being in staggered portion with respect to each other so that a tab clamped between said base and said clamp portion is deformed into a serpentine curve.

6. A strip as claimed in claim 2, wherein said lock section is divided into two portions with said wire connection neck lying therebetween.

7. A strip as claimed in claim 6, wherein said terminals lie side by side and are connected to one another by bridges extending from boundaries of said base not contiguous with said spring section of said lock section.

8. A strip as claimed in claim 1, wherein said wire connection neck extends from a boundary of said base not contiguous with said spring section of said lock section and each of said terminals is connected to runners running lengthwise of the strip by a first bridge extending from said wire connection neck and by a second bridge extending from said base.

9. A strip as claimed in claim 1, wherein the base of each of said terminals includes a hole positioned beneath an edge of the clamp portion providing a leverage point for releasing said clamp portion.

10. A strip as claimed in claim 1, said spring section being formed into a roll curving up and back through an angle over 180 deg, and there being a backward bend of the stock of about 90 deg. in a region joining the spring section and the clamp portion, said roll and said bend positioning said clamp portion above and at an angle to said base, the angle opening away from the spring section.

11. A strip as claimed in claim 10, wherein said spring section has an aperture therein for admission of said tab.

12. A strip as claimed in claim 10, wherein said clamp portion has protuberances extending toward said base for pressing against said flexible sheet.

13. A strip as claimed in claim 10, wherein said base has protuberances extending toward said clamp portion for pressing against said flexible sheet.

14. A strip as claimed in claim 10, wherein said clamp portion has protuberances extending toward said base for pressing against said flexible sheet and wherein said base has protuberances extending toward said clamp portion for pressing against said flexible sheet, said clamp protuberances and said base protuberances being in staggered position with respect to each other so that a tab clamped between said base and said clamped portion is deformed into a serpentine curve.

15. A strip as claimed in claim 11, wherein said lock section is divided into two portions with said wire connection neck lying therebetween.

16. A strip as claimed in claim 15, wherein said terminals lie side by side and are connected to one another by bridges extending from edges of said base not contiguous with said spring section or said lock section.

17. A strip as claimed in claim 10, wherein said wire connection neck springs from an edge of said base not contiguous with said spring section or said lock section and each of said terminals is connected to runners running lengthwise of the strip by a first bridges extending from said wire connection neck and by a second bridge springing from said base.

18. A terminal formed from a single piece of sheet stock, for electrically connecting an electrically conductive wire to a tab of a flexible sheet at least one surface of which is electrically conductive, said terminals having a base of generally rectangular form, a spring section extending from a first side of said base, a clamp portion extending from said spring section in a direction away from said base, a lock section extending from a side of said base opposite from said first side, a wire connection neck extending from one side of said base, said spring section being formed into a roll curving up and back through an angle over 180 deg, and there being a backward bend of the stock of about 90 deg. in a region joining the spring section and the clamp portion, said roll and said bend positioning said clamp portion above and at an angle to said base, the angle opening away from the spring section, said lock section being rolled up and back over said base so that the tip thereof provides a catch for said clamp portion.

19. A terminal as claimed in claim 18, wherein said spring section has an aperture therein for admission of said tab.

20. A terminal as claimed in claim 18, wherein said clamp portion has protuberances extending toward said base for pressing against said flexible sheet.

21. A terminal as claimed in claim 18, wherein said base has protuberances extending toward said clamp portion for pressing against said flexible sheet.

22. A terminal as claimed in claim 18, wherein said clamp portion has protuberances extending toward said base for pressing against said flexible sheet and wherein said base has protuberances extending toward said clamp portion for pressing against said flexible sheet, said clamp protuberances and said base protuberances being in staggered position with respect to each other so that a tab clamped between said base and said clamped portion is deformed into a serpentine curve.

23. A terminal as claimed in claim 19, wherein said lock section is divided into two portion with said wire connection neck lying therebetween.

24. A terminal as claimed in claim 18, wherein the base has a hole positioned beneath an edge of the clamp portion providing a leverage point for releasing said clamp portion.

* * * * *